US007836834B2

(12) United States Patent
Brault et al.

(10) Patent No.: US 7,836,834 B2
(45) Date of Patent: Nov. 23, 2010

(54) WORKTABLE COMPRISING A MULTIDIRECTIONAL COUPLING

(75) Inventors: Jean Brault, Lachine (CA); Annie Roy, Montréal (CA); Thierry Krick, Coteau-du-Lac (CA)

(73) Assignee: Systèmes de Mobilier Triangle Inc., Vaudreuil, Quebec (CA)

( * ) Notice: Subject to any disclaimer, the term of this patent is extended or adjusted under 35 U.S.C. 154(b) by 456 days.

(21) Appl. No.: 10/585,096

(22) PCT Filed: Jan. 7, 2005 (Under 37 CFR 1.47)

(86) PCT No.: PCT/CA2005/000018

§ 371 (c)(1), (2), (4) Date: Sep. 23, 2008

(87) PCT Pub. No.: WO2005/065482

PCT Pub. Date: Jul. 21, 2005

(65) Prior Publication Data

US 2010/0101461 A1 Apr. 29, 2010

Related U.S. Application Data

(60) Provisional application No. 60/535,519, filed on Jan. 12, 2004.

(51) Int. Cl.
*A47B 11/00* (2006.01)

(52) U.S. Cl. ..... 108/140; 312/196

(58) Field of Classification Search ..... 312/196, 312/223.3, 280, 281, 125, 135, 305; 108/143, 108/137, 139, 140, 103, 102, 50.01, 50.02, 108/142, 22; 211/144, 163, 58, 56, 78, 131.1; 248/349.1, 430, 344.21, 344.26, 344.1, 349
See application file for complete search history.

(56) References Cited

U.S. PATENT DOCUMENTS 1,285,628 A * 11/1918 Craley ..... 384/39
2,118,620 A 5/1938 Orsenigo
2,235,660 A 3/1941 Wiepert
2,414,110 A * 1/1947 Lee et al. ..... 248/349.1

(Continued)

*Primary Examiner*—Janet M Wilkens
(74) *Attorney, Agent, or Firm*—François Martineau

(57) ABSTRACT

The worktable comprises a work platform and a multidirectional coupling for operatively attaching the work platform to an external structure. The multidirectional coupling comprises a first linear assembly comprising a first translation member and a second translation member engaging the first translation member and linearly movable relative to and along the first translation member between first and second limit positions and according to a first translation axis. The multidirectional coupling also includes a second linear assembly comprising a third translation member and a fourth translation member engaging the third translation member and linearly movable relative to and along the third translation member between third and fourth limit positions and according to a second translation axis that is transversal to the first translation axis. The multidirectional coupling further includes a swivel assembly comprising a first swivel member and a second swivel member engaging the first swivel member and rotatable relative to the first swivel member about a swiveling axis that is transversal to both the first and the second translation axes. The work platform is allowed to be displaced along the first and second translation axes and rotated about the swiveling axis at any position of the work platform when the multidirectional coupling operatively attaches the work platform to the external structure.

6 Claims, 7 Drawing Sheets

U.S. PATENT DOCUMENTS 2,723,097 A * 11/1955 Tyler ..... 108/28
3,224,391 A 12/1965 Joseph
3,762,275 A 10/1973 Imamura
4,113,223 A * 9/1978 Kakizaki ..... 248/430
4,226,191 A * 10/1980 Espana ..... 108/20
4,305,563 A * 12/1981 Presson ..... 248/349.1
4,564,091 A * 1/1986 Coneglio ..... 190/11
4,637,666 A * 1/1987 Worrell et al. ..... 312/196
4,659,048 A * 4/1987 Fahrion ..... 248/285.1
4,774,442 A * 9/1988 Teramachi ..... 318/135
4,892,283 A * 1/1990 Cutburth ..... 248/466
5,341,700 A * 8/1994 Speranza et al. ..... 74/490.13
5,454,636 A * 10/1995 Taub ..... 312/196
5,460,105 A 10/1995 Given, Jr.
5,503,087 A 4/1996 Hall
5,681,116 A 10/1997 Lin
5,685,719 A * 11/1997 Bressler ..... 434/112
5,724,893 A * 3/1998 Lee et al. ..... 108/20
5,839,373 A 11/1998 Lin
6,196,138 B1 3/2001 Sakai et al.
6,382,745 B1 * 5/2002 Adkins ..... 312/223.3
7,273,212 B1 * 9/2007 Kolbaba ..... 273/280
7,338,023 B2 * 3/2008 Liu ..... 248/284.1
2003/0107305 A1 * 6/2003 Kusztal et al. ..... 312/223.3

* cited by examiner

WORKTABLE COMPRISING A MULTIDIRECTIONAL COUPLING

CROSS-REFERENCE DATA

The present application claims the conventional priority under the Paris Convention of provisional patent application No. 60/535,519 filed in the United States on Jan. 12, 2004 in the name of the present inventors.

FIELD OF THE INVENTION

The present invention relates to worktables, and more particularly to a worktable comprising a multidirectional coupling.

BACKGROUND OF THE INVENTION

It is known to provide worktables that have a movable work platform supported by a base. However, these known worktables do not allow a versatile displacement of the work platform. For example, known prior art worktables have a rotatable work platform that is rotatable and that is further movable along a single linear axis. This lack of displacement capacity is often problematic.

SUMMARY OF THE INVENTION

The present invention relates to a worktable comprising:

a work platform; and a multidirectional coupling for operatively attaching said work platform to an external structure, said multidirectional coupling comprising:

a first linear assembly comprising a first translation member and a second translation member engaging said first translation member and linearly movable relative to and along said first translation member between first and second limit positions and according to a first translation axis;

a second linear assembly comprising a third translation member and a fourth translation member engaging said third translation member and linearly movable relative to and along said third translation member between third and fourth limit positions and according to a second translation axis that is transversal to said first translation axis; and a swivel assembly comprising a first swivel member and a second swivel member engaging said first swivel member and rotatable relative to said first swivel member about a swiveling axis that is transversal to both said first and said second translation axes;

wherein said work platform is allowed to be displaced along said first and second translation axes and rotated about said swiveling axis at any position of said work platform when said multidirectional coupling operatively attaches said work platform to the external structure.

In one embodiment, said second and third translation members are integrally attached to a guide member, said first translation member being a first elongated rail slidable relative to and along said guide member along said first translation axis by the engagement of said first rail on said guide member, and said fourth translation member being a second elongated rail slidable relative to and along said guide member along said second translation axis by the engagement of said second rail on said guide member.

In one embodiment, said first swivel member is fixedly attached to said second rail, said second swivel member is fixedly attached to said work platform, and said first rail is destined to be attached to the external structure.

In one embodiment, said first and second rails have substantially flat elongated main bodies provided with incurved flanges that slidably engage corresponding grooves on said guide member that respectively form said second and third translation members.

In one embodiment, said first and second rails comprise stoppers at the respective extremities of their said elongated main bodies, said guide member being movable relative to said first and second rails along said first and second translation axes between said stoppers on which said guide member can abut, with said stoppers defining said first, second, third and fourth limit positions.

In one embodiment, said first and second translation axes and said swiveling axis are all perpendicular to one another.

DETAILED DESCRIPTION OF THE EMBODIMENTS

Figure 1:
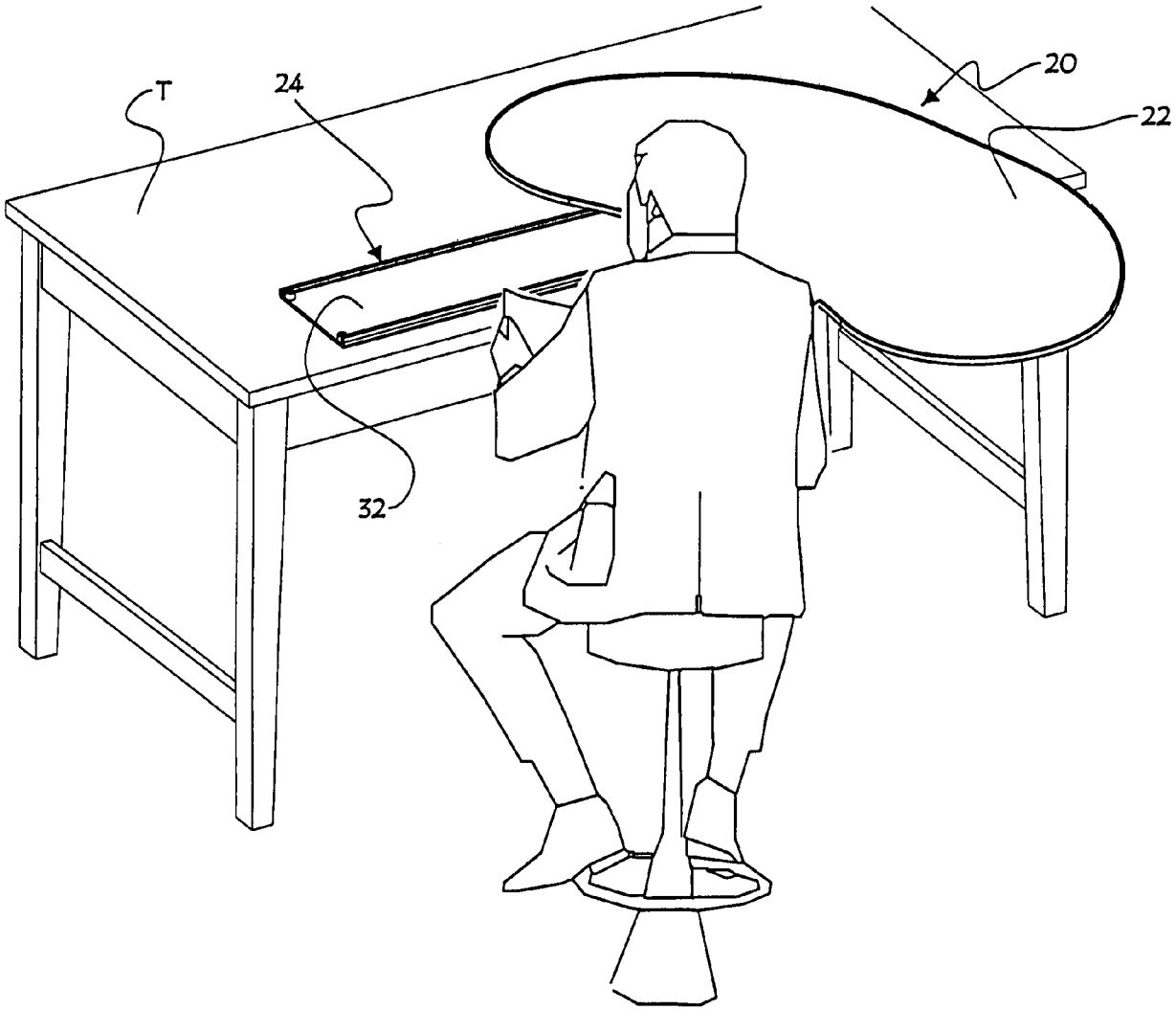
FIG. 1 is a perspective view of the worktable according to the present invention, operatively installed on an external structure, for use by a person located near the worktable.
Figure 2:
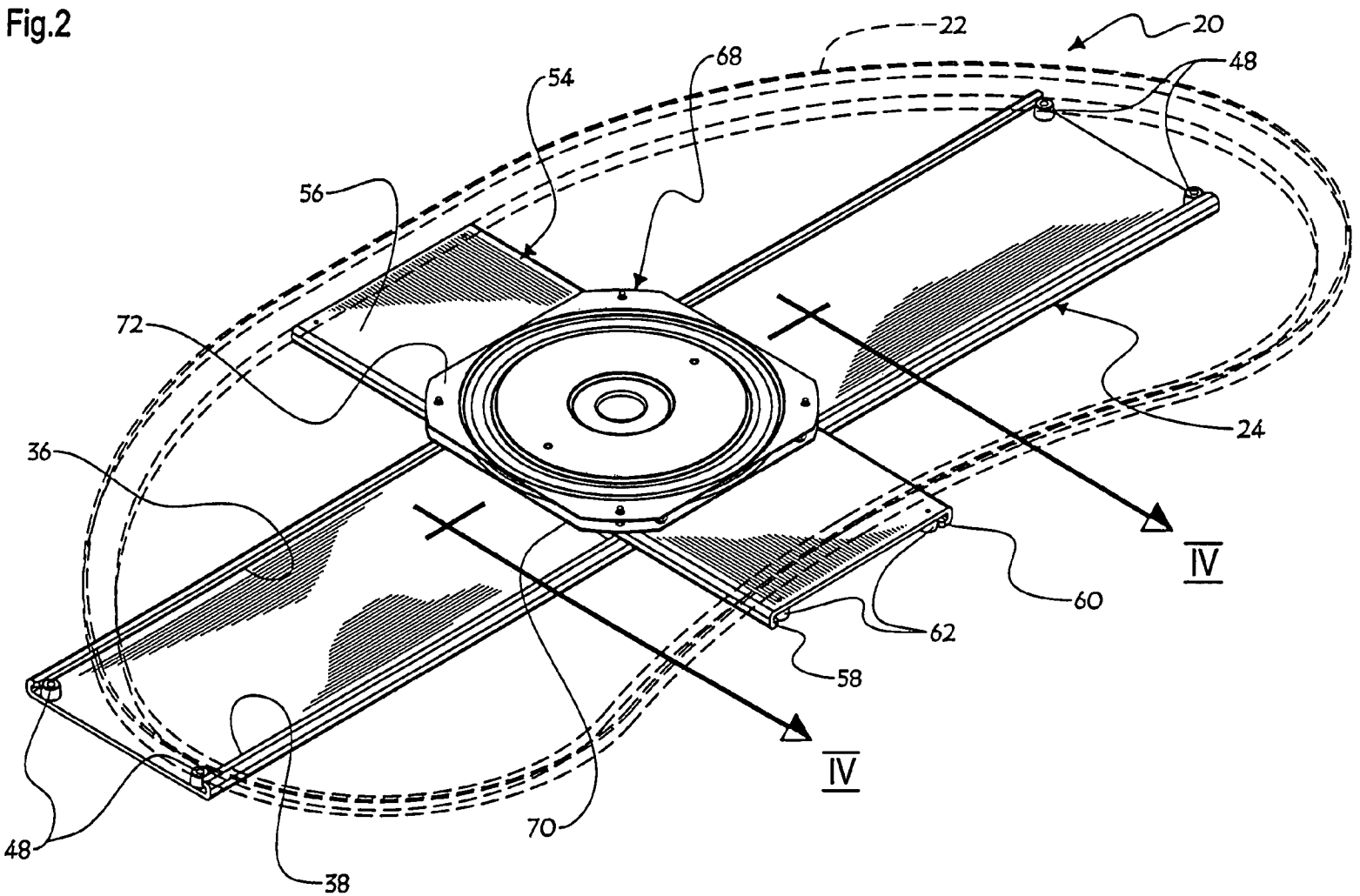
FIG. 2 is an enlarged top perspective view of the worktable of FIG. 1, with the work platform being shown transparent and in dotted lines to allow the multidirectional coupling to be clearly visible.

FIG. 1 shows a worktable 20 according to the present invention, to be operatively installed on an external structure such as a table T, or on any other suitable alternate external structure. For example, worktable 20 could be supported over ground between spaced-apart support elements (not shown). Although not limited to such specific fields of use, worktable 20 is especially adapted for use in specialized professional fields wherein a distinctive, independent and movably versatile worktable is required. For example, this may be the case in the medical or dental fields, where instruments, supplies and apparatuses used by the practitioners may be installed on worktable 20 for easy access thereto, while defining a specific area for these elements.

FIGS. 1-4 show that worktable 20 comprises a work platform 22 and a multidirectional coupling 24 for operatively attaching work platform 22 to the external structure T.

Figure 4:
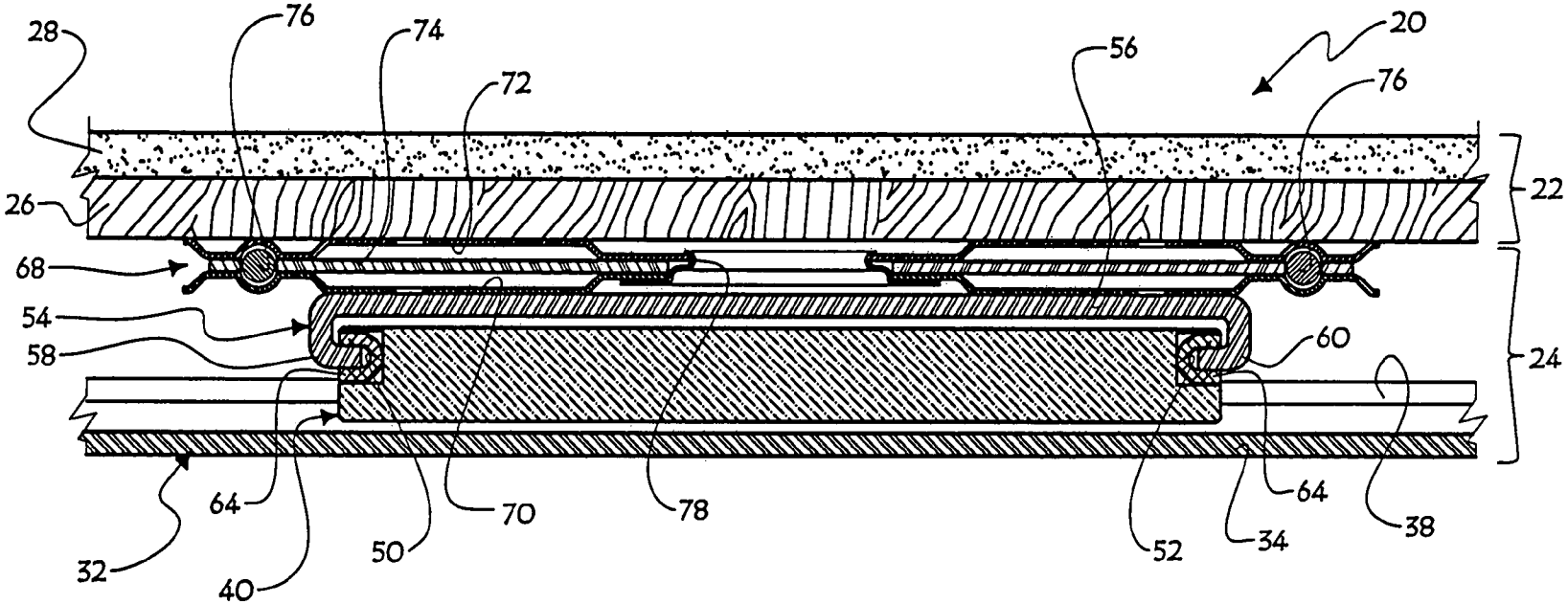
FIG. 4 is an enlarged cross-sectional view of the work table taken along line IV-IV of FIG. 2, with the work platform and the first rail being only partly shown.

In the embodiment shown in the annexed drawings, and as seen more specifically in FIG. 4, work platform 22 is made of two superposed layers, namely a layer of wood 26 and a layer of a composite surface made of polymer and ceramic. It is understood however that work platform 22 could be made of any suitable material, and could be made for example as a unitary platform member.

FIGS. 1-4 shows that multidirectional coupling 24 comprises a first rail 32 that defines a substantially flat elongated main body 34 provided with incurved flanges 36, 38 along the two longitudinal side edges of main body 34.

Figure 5:
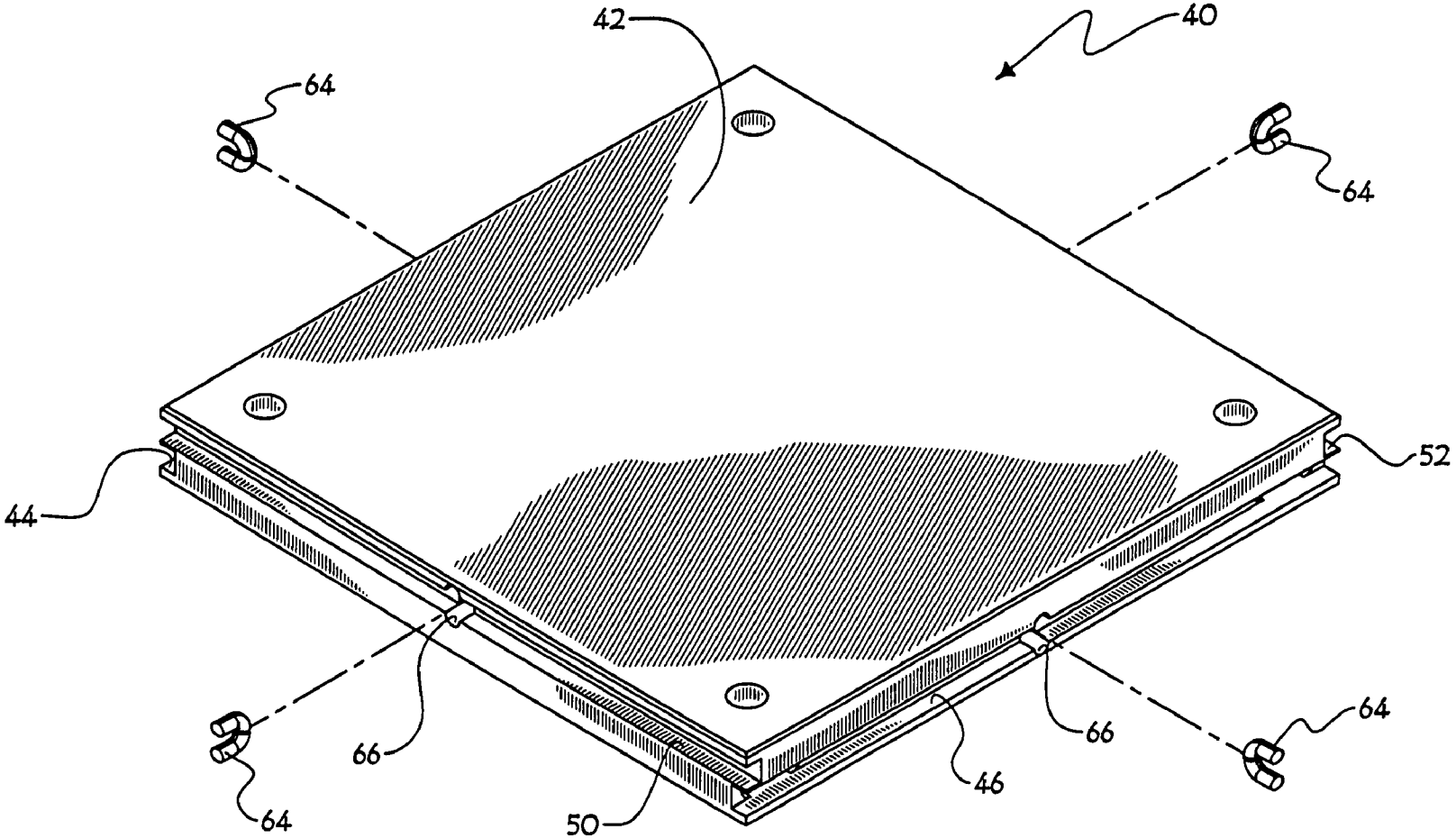
FIG. 5 is an enlarged view of the area circumscribed by line V-V of FIG. 3.

A guide member 40 is slidable along first rail 32. As further shown in FIG. 5, guide member 40 comprises a generally rectangular flat main body 42 provided with a first pair of grooves 44, 46 on two opposite side edges thereof, with flanges 36 and 38 of first rail 32 respectively engaging grooves 44 and 46 (as suggested in FIG. 3) to provide for a sliding relative interconnection of guide member 40 along elongated first rail 32. Stoppers 48 fixedly attached at the two extremities of first rail 32 prevent guide member 40 from disengaging first rail 32 by allowing guide member 40 to abut thereon. Thus, guide member 40 may slide along a sliding channel formed along first rail 32 between flanges 36, 38, between two limit positions that correspond to the abutment of guide member 40 against the stoppers 48 at the opposite extremities of first rail 32.

Guide member 40 also comprises a second pair of grooves 50 and 52 that are also located on opposite side edges of guide member 40, albeit on different edges than those of the first pair of grooves 44, 46.

Figure 3:
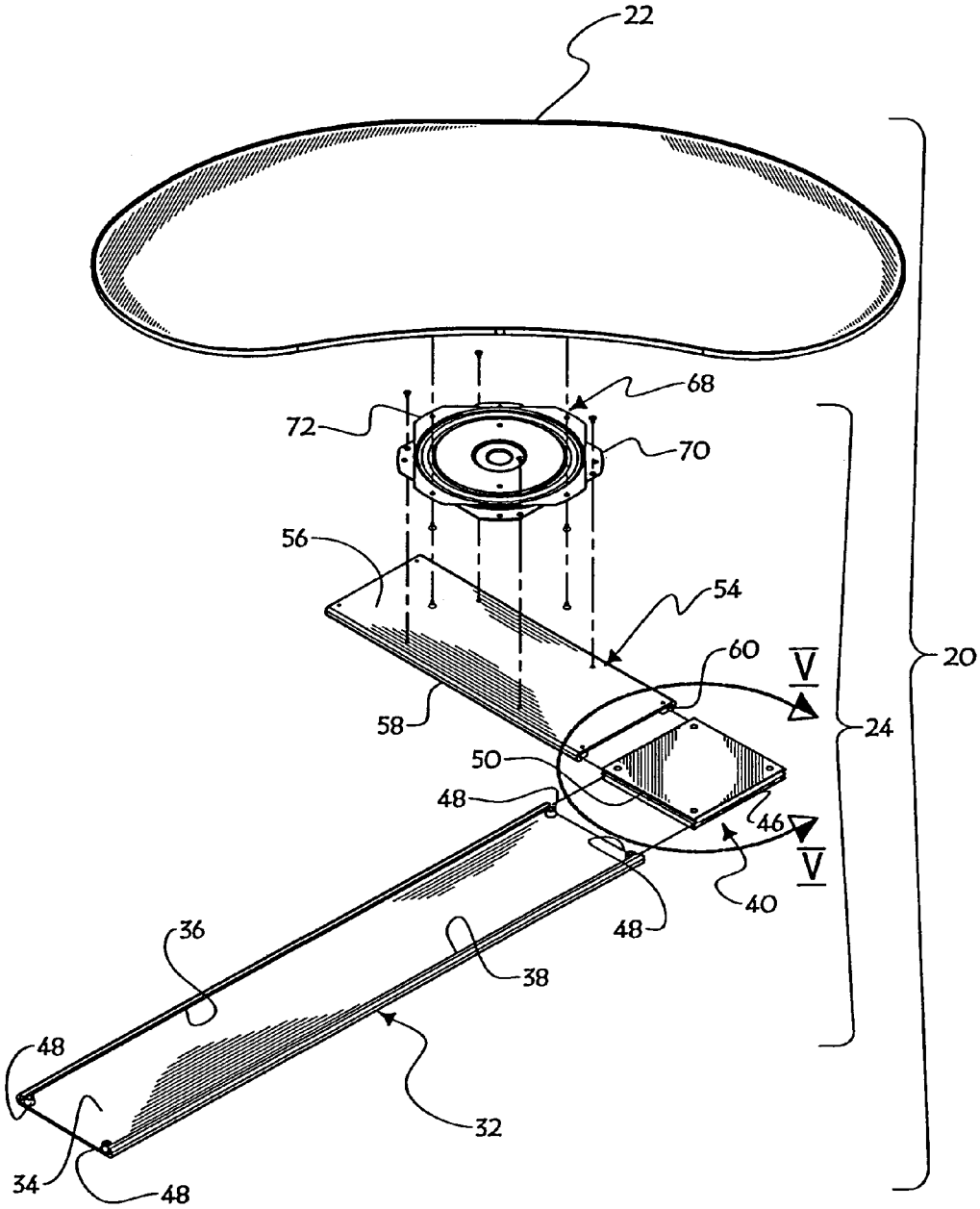
FIG. 3 is an exploded perspective view of the work table of FIG. 2 with the work platform in full lines.

Multidirectional coupling 24 further includes a second rail 54 that defines a substantially flat elongated main body 56 provided with incurved flanges 58, 60 along the two longitudinal side edges of main body 56. Flanges 58 and 60 of second rail 54 respectively engage grooves 50 and 52 of guide member 40 (as shown in FIGS. 3 and 4) to provide for a sliding relative interconnection of guide member 40 along elongated second rail 54. Stoppers 62 fixedly attached at the two extremities of second rail 54 prevent guide member 40 from disengaging second rail 54 by allowing guide member 40 to abut thereon. Thus, guide member 40 may also slide along a sliding channel formed along second rail 54 between flanges 58, 60, between two limit positions that correspond to the abutment of guide member 40 against the stoppers 60 at the opposite extremities of second rail 54.

It can be seen that the first and second pairs of grooves 44, 46 and 50, 52 are vertically offset, i.e. the first pair of grooves 44, 46 is lower than the second pair of grooves 50, 52 on the respective sides edges of guide member 40, to allow guide member 40 to simultaneously be engaged by each one of first and second rails 32, 54 that will be allowed to slide relative to guide member 40 at all times notwithstanding the presence or position of the other one of first and second rails 32, 54. Indeed, first rail 32 will slide underneath guide member 40 and will engage first pair of grooves 44, 46 that is located near the lower surface of guide member 40, while second rail 54 will slide over guide member 40 and will engage second pair of grooves 50, 52 that is located near the upper surface of guide member 40.

Optional lubrication means can be provided between first and second rails 32, 54 and guide member 40. For example, in the embodiment shown in the drawings, grease-oversaturated U-shaped lubrication strings 64 are inserted in corresponding openings 66 that allow strings 64 to protrude slightly within corresponding grooves 44, 46, 50, 52. Thus, as first and second rails 32, 54 move relative to guide member 40, the flanges 36, 38, 58, 60 of first and second rails 32, 54 will slide within grooves 44, 46, 50, 52 and within the channels formed by the U-shaped strings 64, the latter gradually freeing lubricating grease to facilitate the sliding engagement of rails 32, 54 relative to guide member 40.

It is noted that first rail 32 and first pair of grooves 44, 46 of guide member 40 define a first linear assembly comprising:

- a first translation member formed by first rail 32 and its flanges 36, 38; and
- a second translation member formed by guide member 40 and its first pair of grooves 44, 46.

This second translation member engages first rail 32 and is linearly movable relative to and along first rail 32 according to a first translation axis.

Also, guide member 40 and its second pair of grooves 50, 52 together with second rail 54 define a second linear assembly comprising:

- a third translation member formed by guide member 40 and its second pair of grooves 50, 52; and
- a fourth translation member formed by second rail 54 and its flanges 58, 60.

The second rail 54 engages this third translation member and is linearly movable relative to and along guide member 40 and its second pair of grooves 50, 52 according to a second translation axis that is transversal to the first translation axis. In the embodiment shown in the drawings, guide member 40 is rectangular and the second translation axis is perpendicular to the first translation axis, although it is understood that in alternate embodiments of the invention (not shown) the first and second translation axes could be transversal without however being perpendicular.

Multidirectional coupling 24 also comprises a swivel assembly 68 that comprises first and second rotatable swivel members 70, 72 both in the form of discs which are superposed atop one another and which rotatably engage each other so as to allow relative rotation of first and second swivel members 70, 72 about a swiveling axis that is transversal to both the first and the second translation axes. In the embodiment shown in the drawings, the swiveling axis is more particularly perpendicular to the first and second translation axes. Swivel members 70, 72 are spaced-apart from each other by means of a low-friction intermediate disc 74 that facilitates the relative rotation of swivel members 70, 72. For example, swivel members 70, 72 may be made of metal, whereas intermediate disc 74 may be made of a low-friction material such as TEFLON (registered trademark). A series of balls 76 are peripherally installed in a channel formed between swivel members 70, 72, as in many convention ball-bearing swivel members. An annular central clip 78 retains swivel members 70, 72 in their proximate engagement.

First swivel member 70 is fixedly attached to second rail 54 centrally thereof and opposite the sliding channel formed between flanges 58, 60, and second swivel member 72 is fixedly attached underneath work platform 22.

Figure 6:
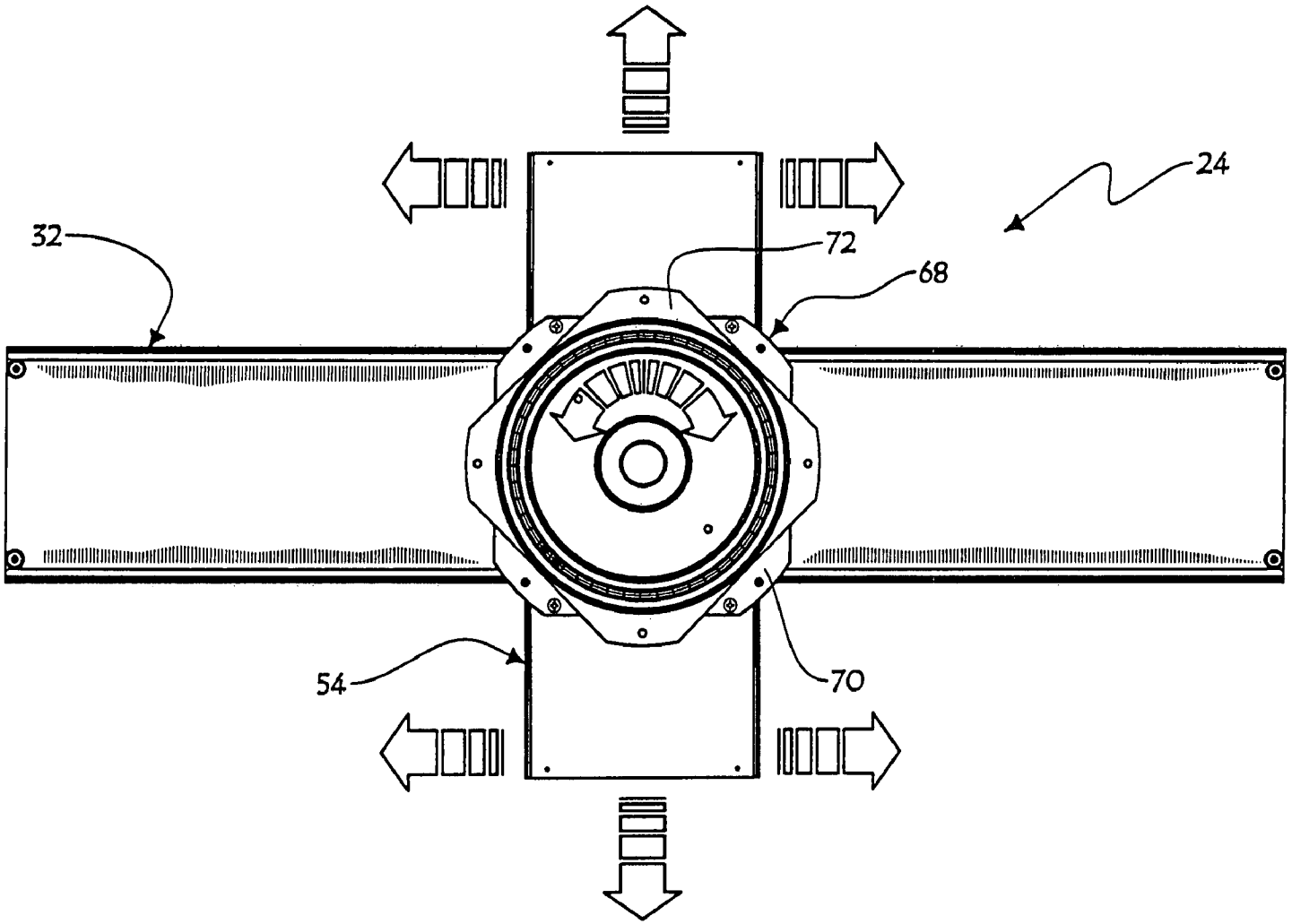
FIG. 6 is a top plan view of the multidirectional coupling of the worktable of FIGS. 1-4, suggesting with arrows the different displacement capacities allowed by the multidirectional coupling.

In use, first rail 32 is to be fixed to the external structure, such as table T, which is to support worktable 20. As suggested in FIG. 6, multidirectional coupling 24 allows the displacement of work platform 22 relative to the external structure to which it is attached by means of multidirectional coupling 24, along the transversal first and second translation axes, in addition to allowing the rotation of work platform 24 about the swiveling axis. Indeed, work platform 22 may be moved along the first translation axis by sliding guide member 40 along first rail 32. Work platform 22 may further be moved along the second translation axis by sliding second rail member 54 atop guide member 40. And work platform 22 may finally be swiveled about its swiveling axis by rotating second swivel member 72 relative to first swivel member 70. All of these displacements of work platform 22 may be accomplished by manually forcing work platform 22 in the desired direction. Multiple simultaneous displacements are also possible: work platform may for example be moved diagonally along a direction including first and second translation axis vectorial components while simultaneously being pivoted about its swiveling axis.

Moreover, the displacement of work platform 22 along the first translation axis is allowed at any position of work platform along second rail 54; the displacement of work platform 22 along the second translation axis is allowed at any position of work platform 22 along first rail 32; and a full 360° swiveling displacement of work platform 22 is allowed at any position of work platform 22 along both first and second rails 32, 54. Indeed, the sliding relationship of guide member 40 within the respective first and second rail sliding channels, and the swiveling capacity of swivel assembly 68, are not hindered by the structural components of worktable 20, nor are they limited thereby.

Figure 7:
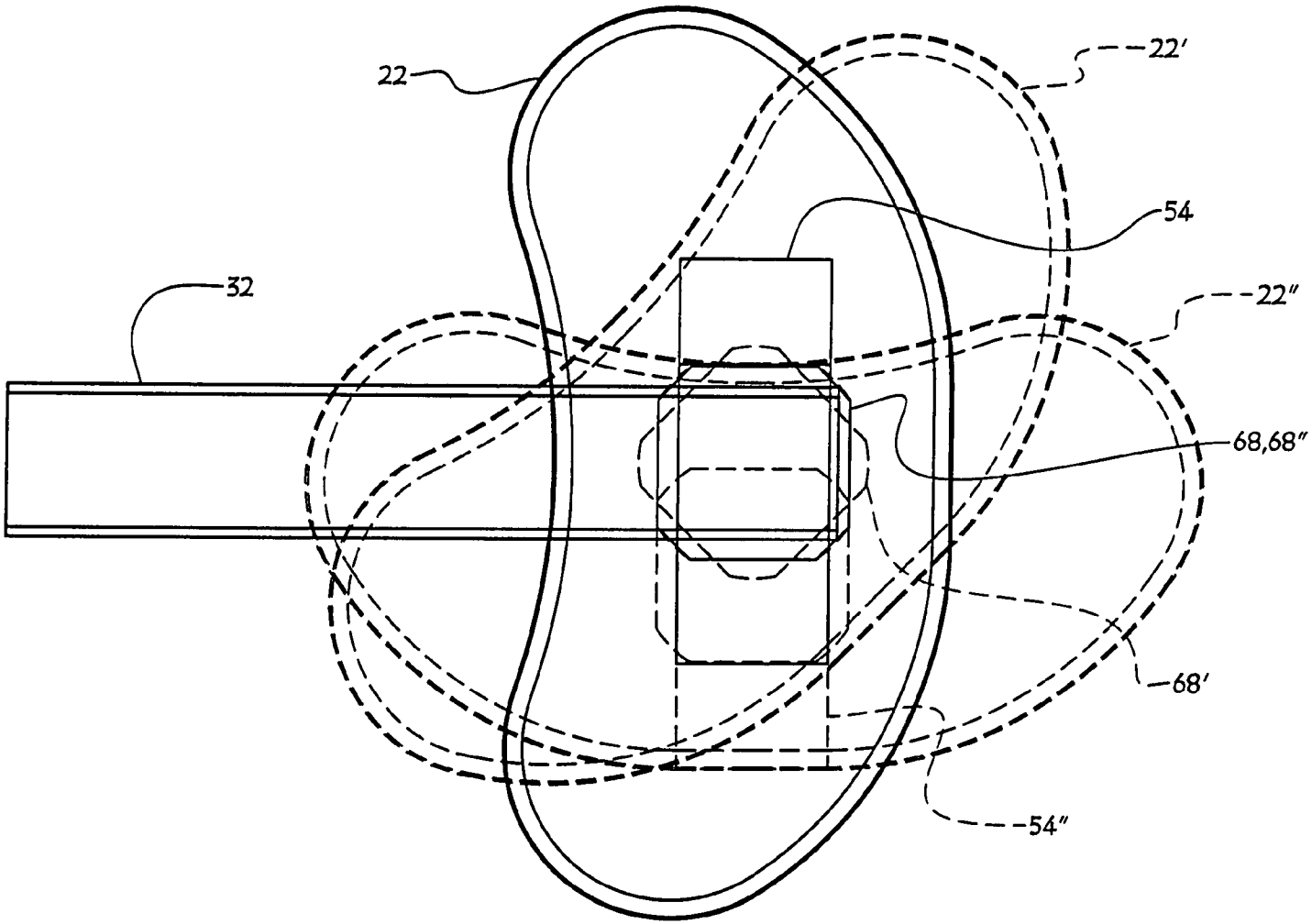
FIG. 7 is a top plan view of the work table of the present invention, showing in full lines a first exemplary position of the work platform, and in dotted lines second and third exemplary positions of the work platform, as allowed by the multidirectional coupling of the worktable.

FIG. 7 shows examples of positions that can be adopted by work platform 22. In all positions shown in FIG. 7, first rail 32 is fixed (presumably to an external structure such as table T of FIG. 1), and guide member 40 (concealed in FIG. 7) is located at the right-hand side (in FIG. 7) extremity of first rail 32. In a first position of work platform 22 shown in full lines, second rail 54 is centered relative to first rail 32, i.e. second rail 54 is positioned in its sliding engagement with guide member 40 so that guide member 40 is located centrally along second rail 54. Moreover, second swivel member 72 of swivel assembly 68 is positioned in a first angular position such that work platform 22 is generally parallel to second rail 54.

A second position of work platform 22' is shown in dotted lines with reference numbers of elements which are positioned differently than at the first position of work platform 22 being primed. In this second position of work platform 22', second rail 54 is at a same position relative to first rail 32 and to guide member 40 than in the first position of work platform 22, but second swivel member 72 (concealed in FIG. 7) of swivel assembly 68' is pivoted so that work platform 22' is angularly offset relative to its first position of about 45°.

A third position of work platform 22" is shown in dotted lines with reference numbers of elements which are positioned differently than at the first position of work platform 22 being double primed. In this third position of work platform 22", second rail 54" is moved along guide member 40 until guide member 40 is located at one end of second rail 54", and second swivel member 72 (concealed in FIG. 7) of swivel assembly 68" is pivoted so that work platform 22" is further angularly offset relative to its first position in an angular position that is generally parallel to first rail 32.

The above positions 22, 22' and 22" of the work platform shown in FIG. 7 are exemplary only, and it is understood that they are by no means restrictive.

In alternate embodiments of the invention, the order in which the first linear and second linear assemblies and the swiveling assembly are provided, could be shuffled to provide for example a multidirectional coupling where the swiveling assembly would be located between the two linear assemblies. In such a case, the work platform would be fixed to one of the two linear assemblies.

The lengths of the first and second rails 32, 54 are shown to be different in the annexed drawings, with second rail 54 being shorter than first rail 32, but it is is understood that first and second rails 32, 54 could have any suitable selected relative lengths.

We claim:

1. A worktable comprising:

a work platform; and a multidirectional coupling for operatively attaching said work platform to an external structure, said multidirectional coupling comprising:

a first linear assembly comprising a first translation member and a second translation member engaging said first translation member and linearly movable relative to and along said first translation member between first and second limit positions and according to a first translation axis;

a second linear assembly comprising a third translation member and a fourth translation member engaging said third translation member and linearly movable relative to and along said third translation member between third and fourth limit positions and according to a second translation axis that is transversal to said first translation axis; and a swivel assembly comprising a first swivel member and a second swivel member engaging said first swivel member and rotatable relative to said first swivel member about a swiveling axis that is transversal to both said first and said second translation axes;

wherein said work platform is allowed to be displaced along said first and second translation axes and rotated about said swiveling axis at any position of said work platform when said multidirectional coupling operatively attaches said work platform to the external structure; wherein said second and third translation members are integrally attached to a guide member, said first translation member being a first elongated rail, said guide member slidable relative to and along said first elongated rail along said first translation axis by the engagement of said guide member on said first elongated rail, and said fourth translation member being a second elongated rail slidable relative to and along guide member along said second translation axis by the engagement of said second rail on said second guide member; wherein said first swivel member is fixedly attached to said second rail, said second swivel member is fixedly attached to said work platform, and said first rail is destined to be attached to the external structure; and wherein said first and second rails have substantially flat elongated main bodies provided with incurved flanges that slidably engage corresponding grooves on said guide member that respectively form said second and third translation members.

2. A worktable as defined in claim 1, wherein said first and second rails comprise stoppers at the respective extremities of their said elongated main bodies, said guide member being movable relative to said first and second rails along said first and second translation axes between said stoppers on which said guide member can abut, with said stoppers defining said first, second, third and fourth limit positions.

3. A worktable as defined in claim 1, wherein said first and second translation axes and said swiveling axis are all perpendicular to one another.

4. A multidirectional coupling for use in attaching a work platform to an external structure, comprising:

a first linear assembly comprising a first translation member and a second translation member engaging said first translation member and linearly movable relative to and along said first translation member between first and second limit positions and according to a first translation axis;

a second linear assembly comprising a third translation member and a fourth translation member engaging said first translation member and linearly movable relative to and along said third translation member between third and fourth limit positions and according to a second translation axis that is transversal to said first translation axis; and a swivel assembly comprising a first swivel member and a second swivel member engaging said first swivel member and rotatable relative to said first swivel member about a swiveling axis that is transversal to both said first and said second translation axes; wherein said second and third translation members are integrally attached to a guide member, said first translation member being a first elongated rail, said guide member slidable relative to and along said first elongated rail along said first translation axis by the engagement of said guide member on said first elongated rail, and said fourth translation member being second elongated rail slidable relative to and along said guide member along said second translation axis by the engagement of said second rail on said guide member; wherein said first swivel member is fixedly attached to said second rail, said second swivel member is destined to be fixedly attached to said work platform and said first rail is destined to be attached to the external structure; wherein said first and second rails have substantially flat elongated main bodies provided with incurved flanges that slidably engage corresponding grooves on said guide member that respectively form said second and third translation members.

5. A worktable as defined in claim 4, wherein said first and second rails comprise stoppers at the respective extremities of their said elongated main bodies, said guide member being movable relative to said first and second rails along said first and second translation axes between said stoppers on which said guide member can abut, with said stoppers defining said first, second, third and fourth limit positions.

6. A worktable as defined in claim 4, wherein said first and second translation axes and said swiveling axis are all perpendicular to one another.

* * * * *